US007410195B1

(12) United States Patent
Martin et al.

(10) Patent No.: US 7,410,195 B1
(45) Date of Patent: Aug. 12, 2008

(54) TWO-PART AUTOMATIC BOLT FOR DOORS

(76) Inventors: Frank J. Martin, 11594 Mayfield, Hartland, MI (US) 48353; Ralph D. Maynard, Jr., deceased, late of Dexter MI (US); by John C. Maynard, legal representative, 2362 Bishop Cir., Dexter, MI (US) 48130

( * ) Notice: Subject to any disclaimer, the term of this patent is extended or adjusted under 35 U.S.C. 154(b) by 147 days.

(21) Appl. No.: 10/901,308

(22) Filed: Jul. 28, 2004

(51) Int. Cl.
*E05B 63/20* (2006.01)
*E05C 1/08* (2006.01)

(52) U.S. Cl. ..... 292/332; 292/163; 292/333; 292/DIG. 21

(58) Field of Classification Search ..... 292/332, 292/333, 335, DIG. 31, 163
See application file for complete search history.

(56) References Cited

U.S. PATENT DOCUMENTS

| | | | | | |
|---|---|---|---|---|---|
| 294,560 | A * | 3/1884 | Woodrich et al. | ..... | 70/86 |
| 1,257,998 | A * | 3/1918 | Gruber | ..... | 292/170 |
| 1,302,063 | A * | 4/1919 | Malone | ..... | 292/179 |
| 2,202,916 | A * | 6/1940 | Mussa | ..... | 292/177 |
| 3,143,760 | A * | 8/1964 | Ferguson | ..... | 16/229 |
| 3,578,369 | A * | 5/1971 | Coopersmith | ..... | 292/58 |
| 3,582,122 | A * | 6/1971 | Foster et al. | ..... | 292/335 |
| 4,005,886 | A * | 2/1977 | Lirette | ..... | 292/177 |
| 4,099,753 | A * | 7/1978 | Gwozdz et al. | ..... | 292/177 |
| 4,445,717 | A * | 5/1984 | Imhoff | ..... | 292/177 |
| 4,611,840 | A * | 9/1986 | Martin | ..... | 292/177 |
| 5,004,277 | A * | 4/1991 | Campbell et al. | ..... | 292/166 |
| 5,076,620 | A * | 12/1991 | Campbell et al. | ..... | 292/138 |
| 5,527,074 | A * | 6/1996 | Yeh | ..... | 292/177 |
| 5,570,913 | A * | 11/1996 | Puric | ..... | 292/36 |
| 5,931,515 | A * | 8/1999 | Stendal | ..... | 292/153 |
| 6,409,231 | B1 * | 6/2002 | Rusiana | ..... | 292/33 |
| 6,883,837 | B1 * | 4/2005 | Lin | ..... | 292/33 |

* cited by examiner

*Primary Examiner*—Carlos Lugo

(57) ABSTRACT

A vertical bolt mechanism and installation configuration that avoids damage to a door corner comprises a vertical bolt case of tubular shape and a horizontal tubular transfer case. The mechanism is substantially contained within the bolt case and transfer case. In the installation in a door, the bolt case and the transfer case require only two major holes in the door top and edge, each hole being well spaced from the door corner and the axis of each hold being directed perpendicular to the other. Installation requires insertion of the bolt case through the hole in the top of the door and the transfer case through the hole in the edge of the door. The two cases come together to form an L-shape within the door with the internal mechanism of each case joined in engagement. Routing or cutting out of the door at the corner is thus avoided.

5 Claims, 2 Drawing Sheets

TWO-PART AUTOMATIC BOLT FOR DOORS

This application claims the benefit of provisional patent application No. 60/309,093 filed Jul. 31, 2001.

BACKGROUND OF THE INVENTION

The field of the invention pertains to double doors that close together without a door frame in between. Normally the active door includes handles and a latch to provide for opening and closing the active door. Thus, at the intermediated handle elevation the passive door includes a strike plate and recess for the latch. The passive door may also include a separate strike plate and recess for a dead bolt at the intermediate level.

At the top corner of the passive door directly above the intermediate elevation strike plate is a vertically movable bolt engageable with a strike plate and recess in the door frame. Extended, the vertically movable bolt prevents opening of the passive door unless the active door is first opened releasing the cam actuator for the vertically movable bolt. In certain applications such as fire doors a bimetallic link will be included in the vertical bolt mechanism to prevent opening of the passive door in the event of high temperatures beyond the door.

Whether a steel door or a wooden door a considerable amount of door structure must be removed at the top corner to accommodate the vertical bolt mechanism. As a result this corner may be significantly weakened in routing out or cutting the door structure without damaging the door surfaces.

With a view toward avoiding significant damage to the passive door structure and simplifying installation of the vertical bolt mechanism the following mechanism configuration has been developed.

SUMMARY OF THE INVENTION

The new vertical bolt mechanism and installation that avoids damage to a door corner configuration comprises a vertical bolt case of tubular shape and a horizontal tubular transfer case. The mechanism is substantially contained within the bolt case and transfer case.

In the installation in the door the bolt case and transfer case require only two major holes in the door top and edge, each major hole being well spaced from the door corner and each major hole being directed perpendicular to the other. Installation requires insertion of the bolt case through the hole in the top of the door and the transfer case through the hole in the edge of the door. The two cases come together to form an L-shape within the door with the internal mechanism of each joined in engagement. Routing or cutting out of the inside of the door at the corner is thus avoided.

DESCRIPTION OF THE PREFERRED EMBODIMENTS

Figure 2:
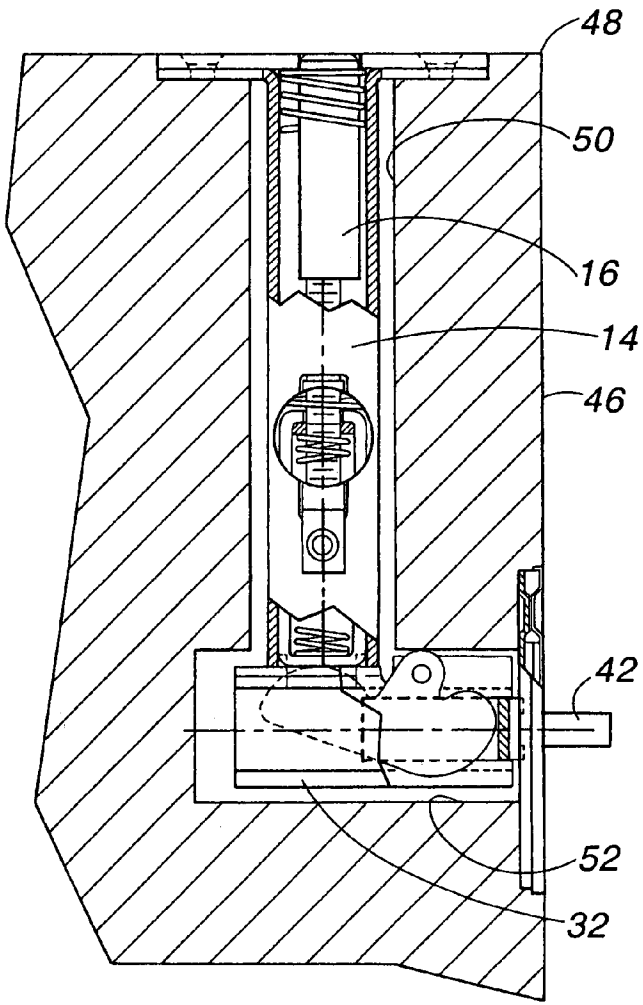
FIG. 2 is a cutaway side view of the vertical bolt mechanism installed in a wooden door.
Figure 1:
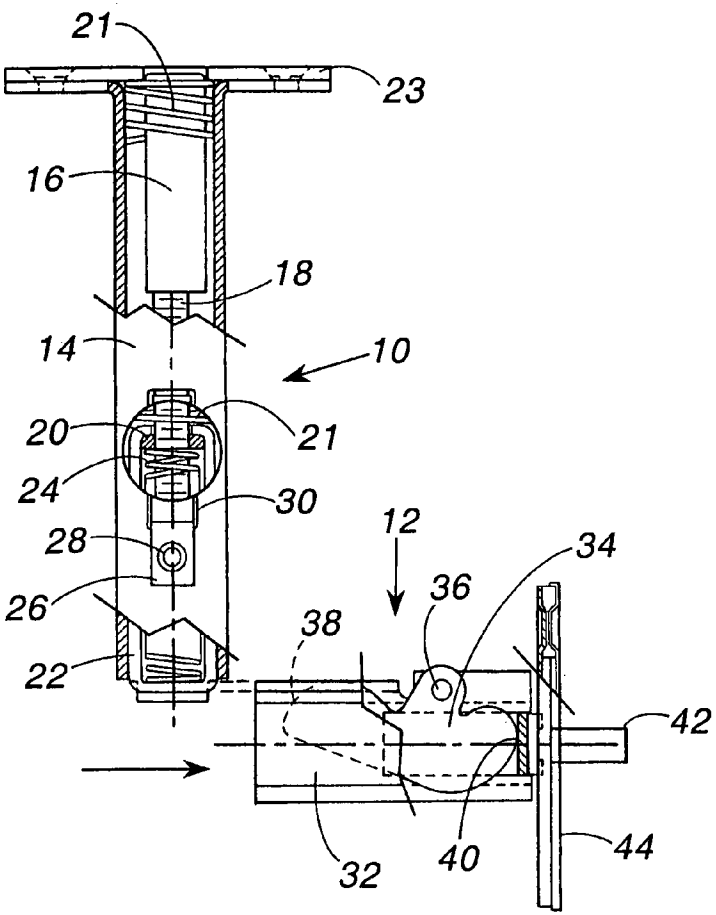
FIG. 1 is a separated side view of the two-piece vertical bolt mechanism for a wooden door.

As shown in FIGS. 1 and 2 the two-part automatic bolt comprises a vertical bolt mechanism generally denoted by 10 and a horizontal transfer mechanism generally denoted by 12. The vertical bolt mechanism 10 comprises a bolthead case 14 containing a bolt head 16 connected to a threaded rod 18 which in turn is threaded into an override guide 20.

The override guide 20 is contained within a transfer box 22 and is urged by an override spring 24 toward the top of the transfer box 22 as shown. A bimetallic strip 26 riveted 28 to the outside of the bolthead case 14 bends through a slot 30 in the case upon heating thereby preventing the bolt head from being retracted. A return spring 21 surrounds the bolthead 16 and threaded rod 18 and engages the underside of the D-hole guide 23 and the top of the transfer box 22.

The horizontal transfer mechanism 12 comprises a transfer case 32 containing a cam 34 rotatable about a pin 36. One end 38 of the cam 34 engages the bottom of the transfer box 22 and the other end 40 of the cam 34 engages a cam actuator and transfer slide 42 which in turn extends beyond a cover plate 44 and the door edge 46.

As is shown in FIG. 2 the corner 48 of the passive door remains undisturbed and structurally sound. A vertical bore 50 and intersecting horizontal bore 52 both spaced from the door corner 48 contain the vertical bolt mechanism 10 and horizontal transfer mechanism 12 respectively. Closure of the active door (not shown) drives the cam actuator 42 into the passive door thereby rotating the cam 34 and driving the transfer box 22 and bolthead 16 upward. The bolthead 16 engages a recess in the door jamb top (not shown) thus preventing the passive door from opening.

Figure 4:
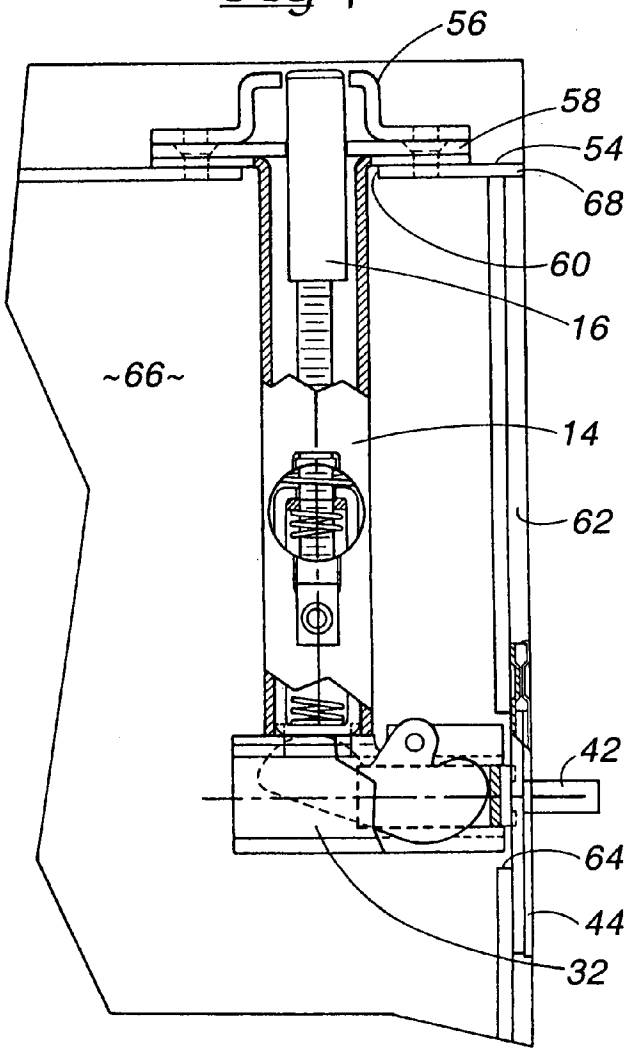
FIG. 4 is a cutaway side view of the vertical bolt mechanism installed in a steel door.
Figure 3:
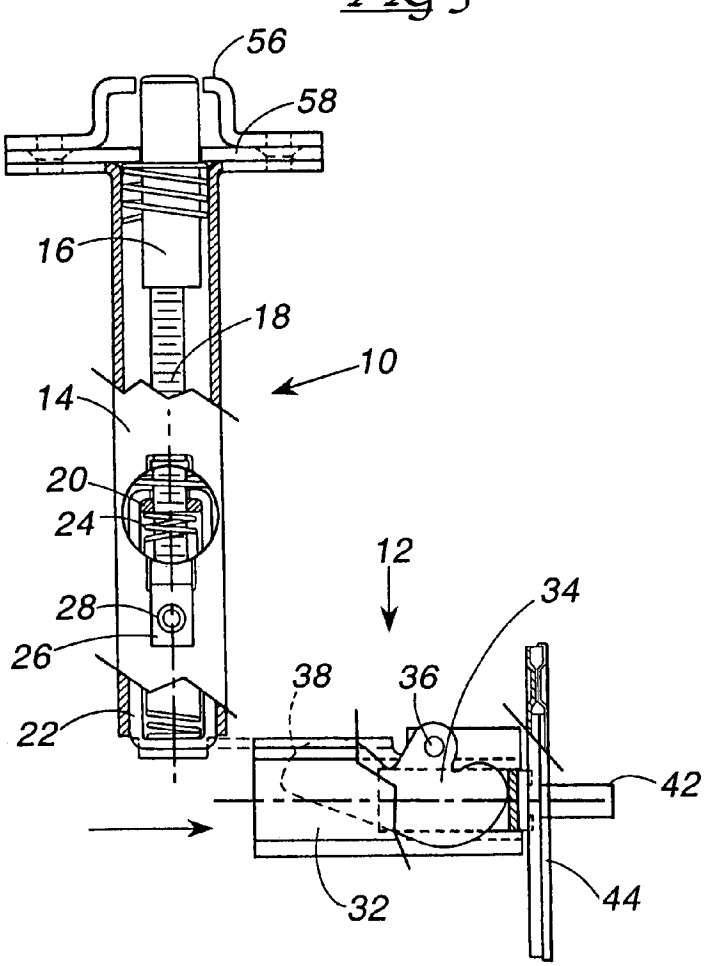
FIG. 3 is a separated side view of the two-piece vertical bolt mechanism for a steel door.

As illustrated in FIGS. 3 and 4 the internal mechanisms within the bolt case 14 and transfer case 32 are substantially the same as above, however, the nature of steel door construction requires some external changes depending on the sheet metal configuration of the door.

The sheet metal door of FIG. 4, for example, is formed with a recessed top 54. A bolthead guide 56 is placed atop the D-hole guide 58 within the recessed top 54. The bolthead 16 is merely extended on the threaded rod 18 to reach the bolthead guide 56. A hole 60 is either punched or cut in the recessed top 54 for the bolthead case 14. A thinner recess 62 accommodates the cover plate 44 and hole 64 for the transfer case 32. Thus, the vertical bolt mechanism 10 and horizontal transfer mechanism 12 are enclosed within the hollow volume 66 of the sheet metal door.

As is apparent the sheet metal door could have a variety of configurations with or without recesses that will accommodate the two-piece automatic bolt without disturbing or weakening door corner 68.

The invention claimed is:

1. A door and automatic bolt combination comprises a first door having a first hole having a vertical axis and being spaced from an upper or lower corner of the first door remote from the door corners about which the first door pivots, a second hole having a horizontal axis and being spaced from the same upper or lower corner of the first door, the corner of the first door remaining intact, a vertical bolt mechanism inserted through the first hole and extensible to latch said first door, and a horizontal transfer mechanism inserted through the second hole, said horizontal transfer mechanism having actuating means engageable with a second mating door, a casing and a pivotable cam, pivotally connected to said casing, with a lobe in contact with said vertical bolt mechanism, wherein movement of said actuating means by engagement with said second mating door pivots said cam to extend said vertical bolt mechanism to latch said first door.

2. The door and automatic bolt combination of claim 1 wherein the first hole intersects the top or bottom of the door and the second hole intersects a vertical edge of the door.

3. The door and automatic bolt combination of claim 2 including means to attach the vertical bolt mechanism to either the top or bottom of the door adjacent the first hole.

4. A door and automatic bolt combination, comprising a door having a first hole having a vertical axis and being spaced from an upper or lower corner of the door remote from the door corners about which the door pivots, and an intersecting second hole having a horizontal axis and being spaced from the same upper or lower corner of the door, the corner of the door remaining intact, a vertical bolt mechanism inserted in the first hole and having a bolt head movable between extended and retracted positions, and a separate horizontal transfer mechanism inserted in the second hole, said vertical bolt mechanism and horizontal transfer mechanism adapted to lie in a vertical plane adjacent an upper or lower corner of a door, said upper or lower corners both remote from the door corners about which the door pivots, said horizontal transfer mechanism comprising a casing, slide means for movement between a retracted position and an extended position and engageable with a second mating door to move to retracted position, and motion transfer means mounted on said horizontal transfer mechanism operable to cause movement of the bolt head to the extended position when the slide means moves to retracted position, and spring means for biasing the bolt mechanism to move the bolt head to retracted position while simultaneously biasing the slide to extended position.

5. The door and automatic bolt combination of claim 4, wherein the motion transfer means is a pivotable two-lobe cam pivotally connected to the horizontal transfer mechanism casing and having one lobe in contact with the slide and the other lobe in contact with the bolt mechanism such that pivotal movement of the cam by movement of the slide to retracted position causes the bolt mechanism to move the bolt head to extended position.

* * * * *